US011400478B2

(12) United States Patent
Huang et al.

(10) Patent No.: US 11,400,478 B2
(45) Date of Patent: Aug. 2, 2022

(54) WATERFALL PROVIDING APPARATUS AND SYSTEM FOR POOL OR SPA

(71) Applicant: BESTWAY INFLATABLES & MATERIAL CORP., Shanghai (CN)

(72) Inventors: Shuiyong Huang, Shanghai (CN); Xinwei Chen, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 16/964,997

(22) PCT Filed: Jan. 31, 2018

(86) PCT No.: PCT/CN2018/074777
§ 371 (c)(1),
(2) Date: Jul. 26, 2020

(87) PCT Pub. No.: WO2019/148380
PCT Pub. Date: Aug. 8, 2019

(65) Prior Publication Data
US 2021/0046500 A1 Feb. 18, 2021

(51) Int. Cl.
*E04H 4/00* (2006.01)
*B05B 17/08* (2006.01)
(Continued)

(52) U.S. Cl.
CPC ..... *B05B 17/085* (2013.01); *E04H 4/0025* (2013.01); *E04H 4/12* (2013.01); *E04H 4/148* (2013.01)

(58) Field of Classification Search
CPC ..... B05B 17/08–085; A61H 33/602–6026; A47K 13/10; E04H 4/0018; E04H 4/0025;
(Continued)

(56) References Cited

U.S. PATENT DOCUMENTS 4,912,782 A * 4/1990 Robbins ..... B05B 1/20 239/520
5,115,974 A * 5/1992 Tobias ..... E04H 4/12 239/23
(Continued)

FOREIGN PATENT DOCUMENTS

CN 204252590 4/2015
CN 204326598 5/2015
(Continued)

OTHER PUBLICATIONS

The First Office Action dated May 31, 2021 (May 31, 2021) issued on related Chinese patent application 201880088150.9 by The State Intellectual Property Office of People's Republic of China.
(Continued)

*Primary Examiner* — David P Angwin
*Assistant Examiner* — Nicholas A Ros
(74) *Attorney, Agent, or Firm* — Dickinson Wright PLLC

(57) ABSTRACT

A waterfall system includes a housing. The housing comprises one or more retention legs and one or more mounting arms. Further in accordance with this aspect, the system also includes a water sprayer, a water collection attachment, and a pump coupled with the water sprayer. Still further, the housing is arranged proximal a spa and is held in place by the one or more retention legs. Additionally, a water collection attachment collects pressurized water from the spa and provides the water under pressure to the water sprayer, which is mounted above the spa by the one or more mounting arms and sprays the water into the spa.

10 Claims, 6 Drawing Sheets

(51) Int. Cl.
*E04H 4/12* (2006.01)
*E04H 4/14* (2006.01)

(58) Field of Classification Search
CPC ..... E04H 4/12; E04H 4/1254; E04H 4/129; E04H 4/14
See application file for complete search history.

(56) References Cited

U.S. PATENT DOCUMENTS

| | | | | |
|---|---|---|---|---|
| 5,217,161 | A * | 6/1993 | Souza | B05B 17/08 239/20 |
| 6,003,166 | A * | 12/1999 | Hald | A61H 33/6026 137/563 |
| 6,357,059 | B1 * | 3/2002 | Lau | A61H 33/0087 4/541.1 |
| 6,450,418 | B1 | 9/2002 | Simpson et al. | |
| 6,595,675 | B2 * | 7/2003 | Dongo | G02B 6/001 362/556 |
| 7,384,165 | B2 | 6/2008 | Doyle | |
| 8,156,578 | B2 * | 4/2012 | Bickmore | E04H 4/14 4/559 |
| 9,217,259 | B1 | 12/2015 | Perrotta | |
| 10,077,571 | B2 * | 9/2018 | Hsu | B05B 17/085 |
| 2002/0154516 | A1 | 10/2002 | Dongo | |
| 2002/0179728 | A1 | 12/2002 | Beidokhti | |
| 2005/0223490 | A1 | 10/2005 | Kunkel | |
| 2005/0268393 | A1 | 12/2005 | Bergstrom | |
| 2010/0187326 | A1 * | 7/2010 | Paroonagian | E04H 4/14 239/17 |
| 2013/0318703 | A1 * | 12/2013 | Berenson | E04H 4/0025 4/494 |
| 2015/0101135 | A1 * | 4/2015 | Witelson | B62D 55/075 15/1.7 |
| 2017/0058544 | A1 | 3/2017 | Lin et al. | |
| 2021/0054640 | A1 * | 2/2021 | Moore | E04H 4/14 |

FOREIGN PATENT DOCUMENTS

| | | | |
|---|---|---|---|
| CN | 204552170 | 8/2015 | |
| CN | 204620311 | 9/2015 | |
| CN | 206355551 | 7/2017 | |
| CN | 206722475 | 12/2017 | |
| CN | 206917343 | 1/2018 | |
| CN | 206928712 | 1/2018 | |
| EP | 1219280 | 7/2002 | |
| WO | WO2017119207 | * 11/2017 | E04H 4/12 |

OTHER PUBLICATIONS

Written Opinion of the International Searching Authority and International Search Report dated Nov. 6, 2018 issued by the State Intellectual Property Office of the Peoples Republic of China / International Search Authority.

Intex Manuel D'utilisation Cascada a Led Multicolore Modele CLW090, Retrieved from the Internet: URL:https://www.jadideco.fr/fiches-notices/notice-intex-cascade-de-piscine-led-multicolore-28090.pdf, retrived Jul. 16, 2021 (Jul. 16, 2021), pp. 1-6.

Extended European Search Report dated Jul. 28, 2021 (Jul. 28, 2021) on related European Patent Application 18903488.7 by the European Patent Office.

* cited by examiner

WATERFALL PROVIDING APPARATUS AND SYSTEM FOR POOL OR SPA

CROSS-REFERENCE TO RELATED APPLICATION

This application is a 35 U.S.C. § 371 national stage application which claims the benefit and priority of PCT Application Ser. No. PCT/CN2018/074777, filed on Jan. 31, 2018, which is hereby incorporated herein by reference in its entirety.

TECHNICAL FIELD

The present subject matter relates to inflatable pools and/or spas, and more particularly, to accessories, including pumps and sprayers, for pools and/or spas.

BACKGROUND

Often times, it is useful, beneficial, and/or entertaining to circulate water within a pool and/or spa, such as by way of a fountain. However, not all spas and/or pools have fountains or other water circulating devices integrated therein. Instead, a fountain, sprayer, or waterfall providing device, which circulates water, provides entertainment, etc., that may be easily added to an inflatable pool and/or spa represents an improvement in the art.

In the current state of the art, fountain-type attachments may be added to existing pump and/or filter mechanisms natively incorporated into hardside pools. However, such attachments are not universally portable to inflatable pools and/or spas, especially inflatable pools and/or spas having relatively small filters more suitable for storage/transport and having structural considerations different from those of hard-sided pools.

To solve this challenge, the below disclosure sets forth a waterfall producing apparatus and/or a system for producing a waterfall effect. Still further, the apparatus and system contemplated herein may be easily added to a side of an inflatable pool/spa to produce an entertaining arc of water.

The description provided in the background section should not be assumed to be prior art merely because it is mentioned in or associated with the background section. The background section may include information that describes one or more aspects of the subject technology.

SUMMARY

According to an aspect of the present disclosure, a waterfall system includes a housing further comprising one or more retention legs and one or more mounting arms. Further in accordance with this aspect, a pump arranged within the housing, and the system also includes a water sprayer and a water collection attachment. Still further, the housing is arranged proximal a spa and is held in place by the one or more retention legs. Additionally, a water collection attachment collects pressurized water from the spa and provides the water under pressure to the water sprayer, which is mounted above the spa by the one or more mounting arms and sprays the water into the spa.

According to another aspect of the present disclosure, a waterfall producing apparatus includes a housing, a pump and a water sprayer wherein the housing mounts the water sprayer to a side of an inflatable pool. This system further includes a water collection attachment coupled to the pump such that the pump draws water from the inflatable pool through the water collection attachment and projects the collected water out of the water sprayer.

Other aspects and advantages of the present invention will become apparent upon consideration of the following detailed description and the attached drawings wherein like numerals designate like structures throughout the specification.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Still further, modules and components depicted may be combined, in whole or in part, and/or divided, into one or more different parts, as applicable to fit particular implementations without departing from the scope of the present disclosure. Accordingly, the drawings and description are to be regarded as illustrative in nature and not restrictive.

Figure 1:
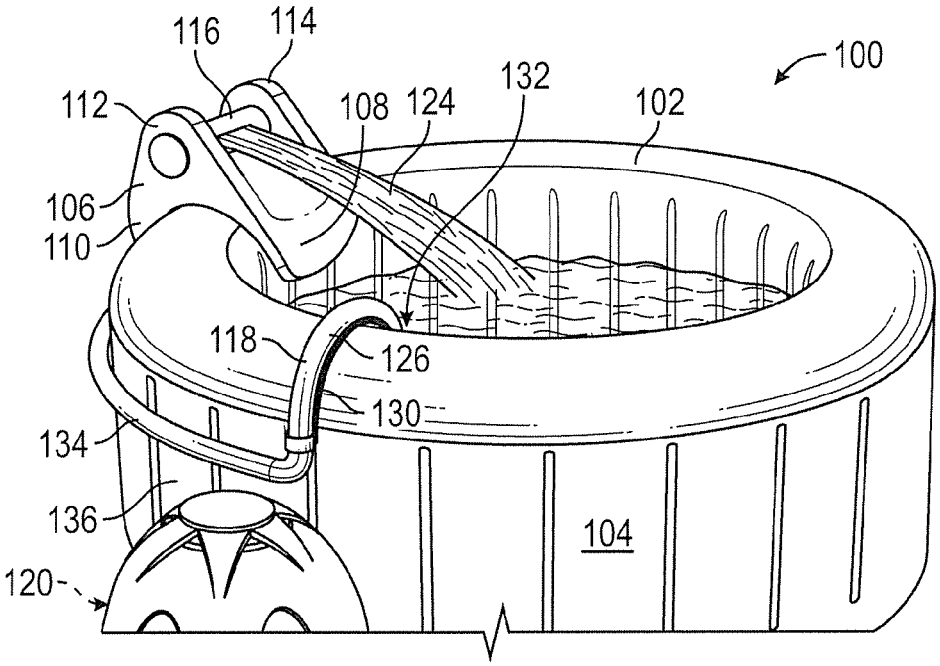
FIG. 1 is a front isometric view of an inflatable pool/spa with an example embodiment of a waterfall system according to aspects of this disclosure.

Referring to FIG. 1, a waterfall system 100 and an apparatus for producing a waterfall effect are illustrated. FIG. 1 depicts an example embodiment of the waterfall system 100 disposed on a side surface 102 of an inflatable pool/spa 104. The waterfall system 100 has a housing body 106 comprising first and second retention legs 108, 110 and first and second mounting arms 112, 114. A water sprayer 116 is mounted between the first and second mounting arms 112, 114. Water is collected from the pool/spa and supplied to the water sprayer 116 by a water collection attachment/component 118. The water sprayer 116 operates to project water 124 out and away therefrom. The projected water 124 may travel in an arcuate projection or pattern and re-enter the inflatable pool/spa 104 thereby creating a waterfall effect.

In further example embodiments, the projected water 124 may travel over and beyond the legs(s) 108, 110 of the housing body 106, particularly according to a configuration wherein the water sprayer 116 is elevated above the side 102 of the pool/spa 104. Further in accordance with example embodiments, the projected water 124 may land on one or more portions/surfaces of the housing body 106, such as one of the leg(s) 108, 110, before re-entering the inflatable pool/spa 104. Still further according to example embodiments, the water sprayer 116 may be positioned above the inflatable pool/spa 104 such that the projected water 124 may be released straight downward and carried into the inflatable pool/spa 104 by gravity in a relatively passive manner as compared with projection of water under pressure, such as might be used to project water laterally.

The water collection attachment 118 is operatively connected to the water sprayer 116 by a pump 120 disposed exterior to the waterfall system 100. The pump may be a filter system disposed on, within, or exterior to the inflatable pool/spa 104. The pump 120 may also be operatively coupled to one or more power sources 122. The one or more power sources 122 may comprise a battery, a solar panel, a plug-in for 120V and/or 240V standard outlet(s), and/or another suitable power source. Relatively low voltage may be suitable for powering the pump 120. In an example embodiment, power for the pump 120 may be supplied by a circulation or filtration system already present in, or compatible with the inflatable pool/spa 104. Specifically, a given amount of water, already under pressure from the circulation/filtration system, may be bleed off of the circulation/filtration system. Thusly, the water sprayer 116 may be supplied with a pressured flow of water. In further example embodiments, the pump 120 may be self-contained, such as within the housing body 106, and may not require connection with any filter/circulation components of the inflatable pool/spa.

Figure 2:
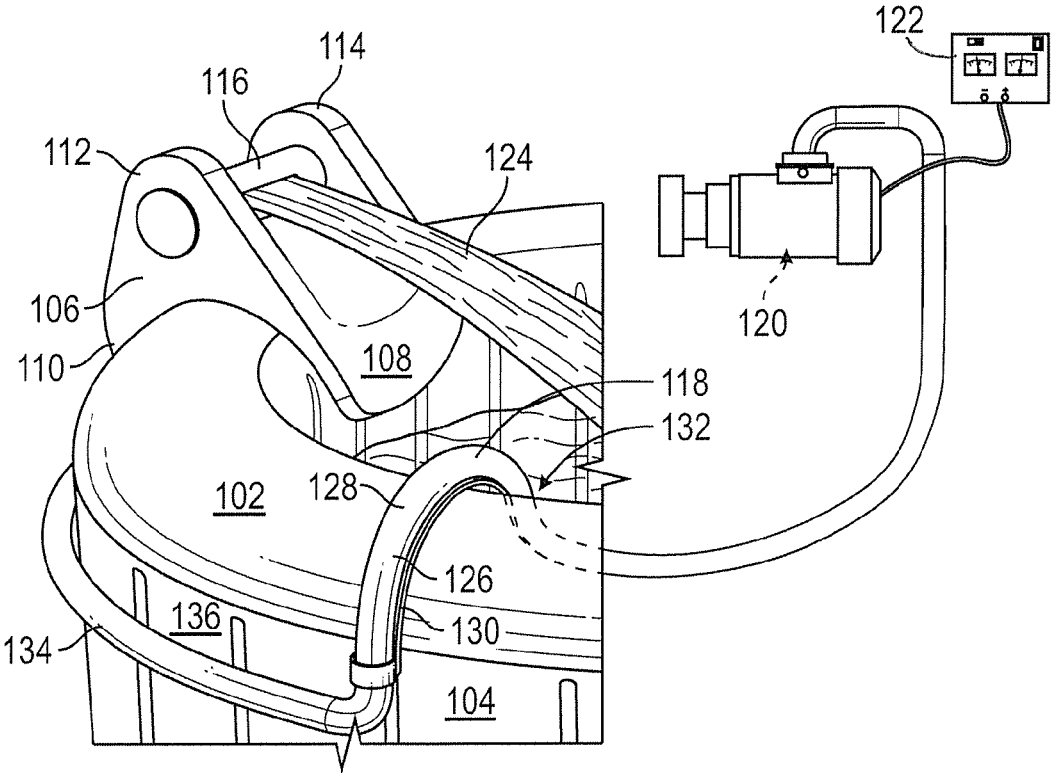
FIG. 2 is an enlarged isometric view of the waterfall system of FIG. 1.
Figure 3:
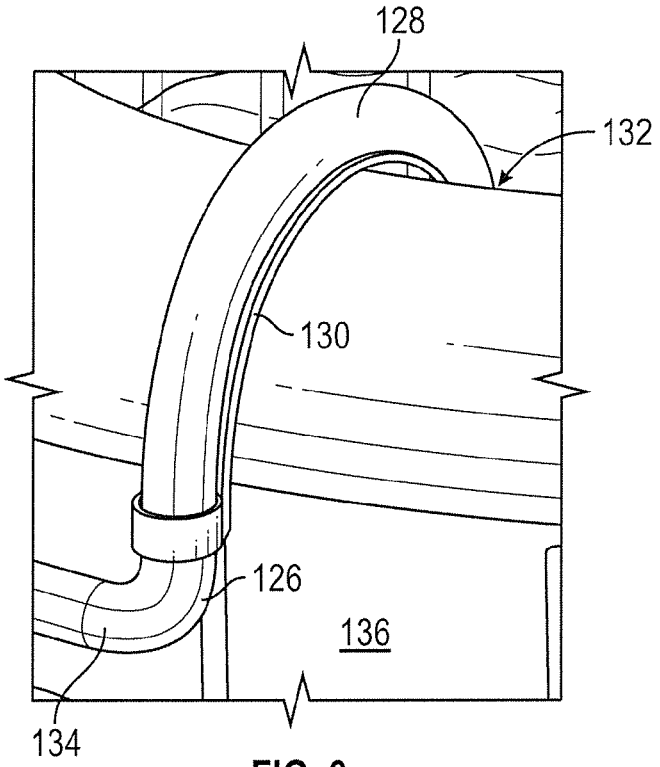
FIG. 3 is an enlarged isometric view of a water collection component of the waterfall system illustrated in FIG. 1.

The water collection attachment 118, as depicted in FIG. 2, may be inserted into the inflatable pool/spa 104. In example embodiments, the water collection attachment 118 comprises a hose 126 disposed over the side surface 102 of the inflatable pool/spa 104. The hose 126 may be formed from plastic, PVC, metal, water-resistant fabric, coated fabric, and/or another suitable material for collecting and transporting water. In the embodiment depicted in FIG. 2, the hose 126 may be a combination of flexible and rigid materials. FIG. 3 shows a flexible portion 128 of the hose 126 disposed within an arcuate saddle 130. The arcuate saddle 130 may have at least one retention ring for affixing the flexible portion 128 of the hose 126 to the curved saddle 130. The arcuate saddle 130 may be arced or shaped such that it corresponds to the rounded side surface 102 of the inflatable pool/spa 104. The shape of the arcuate saddle 130 may hold same in place when hung or placed on the rounded side surface 102.

The arcuate saddle 130 may be rigid, and, therefore, impart the generally curved shape thereof to the flexible portion 128 of the hose 126. In this manner, the flexible portion 128 of the hose 126 is fixedly attached to the inflatable pool/spa 104 and positioned such that a water intake end/component 132 thereof is inserted into the water. The water intake end 132 may be wider than the hose 126 and may further have a grille and/or grating disposed therein to prevent debris from entering the hose 126 and/or reaching the pump 120. Referring once again to FIG. 2, the flexible portion 128 of the hose 126 bends into a rigid portion 134 disposed along an exterior sidewall 136 of the inflatable pool/spa 104. The rigid portion 134 is formed from flexible hose and may be rigidly held against the exterior sidewall 136 of the inflatable pool/spa 104. The rigid portion 134 may carry water directly to a pump intake on and/or within the housing body 106. In an example embodiment, the hose 126. A second flexible portion of the hose 126 may link the rigid portion 134 to the housing body 106.

The saddle 130 depicted in FIG. 3 may also provide additional attaching features for securing the saddle 130 and the hose 126 to the side surface 102 of the inflatable pool/spa 104. In example embodiments, the saddle 130 may have clips disposed thereon that correspond to a clipping/securing surface (such as a hook, mating clip, and/or indentation) on the side surface 102 of the inflatable pool/spa 104. Further according to example embodiments, the saddle 130 may have hook and loop fastener (such as Velcro®) positioned on an underside thereof and corresponding to a strip/patch of hook and loop fastener disposed on the side surface 102 of the inflatable pool/spa 104. Still further in accordance with example embodiments, the saddle 130 may be spring-loaded and/or have elastic/resilient qualities such that the entire body of the saddle 130 acts as a clip/fastener and clips over the side surface 102 of the inflatable pool/spa 104 thereby holding the hose 126 in position to extract water for use by the waterfall system 100. According to example embodiments, one or more small sleeves may be pre-formed in the side surface 102 and/or exterior sidewall 136. The saddle 130 may further have one or more complementary finger projections disposed on an underside thereof, such that said finger projections slide into the one or more small sleeves on the inflatable pool/spa 104 coupling the saddle 130 therewith.

Figure 4:
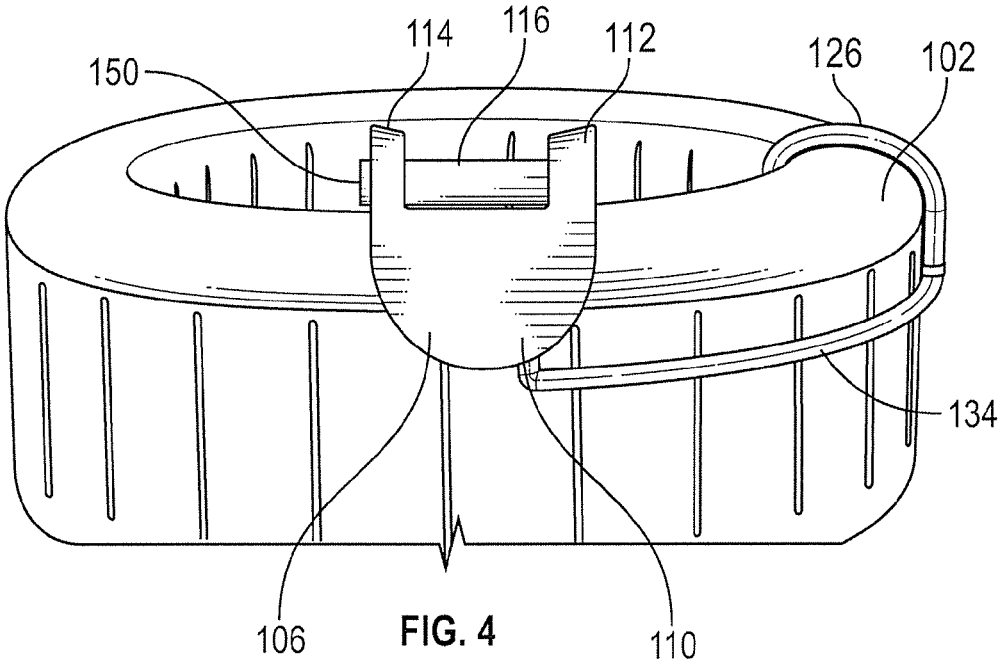
FIG. 4 is an enlarged rear isometric view of a water sprayer component and housing of the waterfall system illustrated in FIG. 1.
Figure 6:
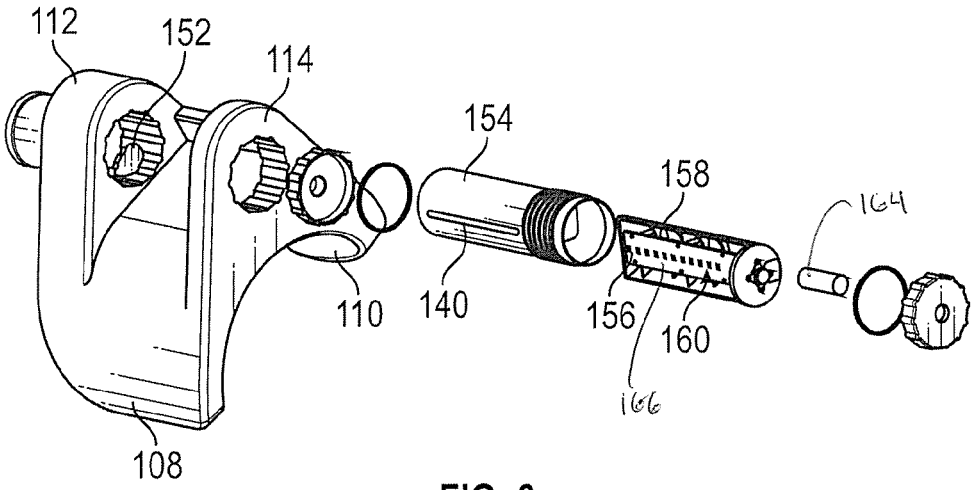
FIG. 6 is an enlarged, exploded, front view of the water sprayer component of FIG. 4.
Figure 8:
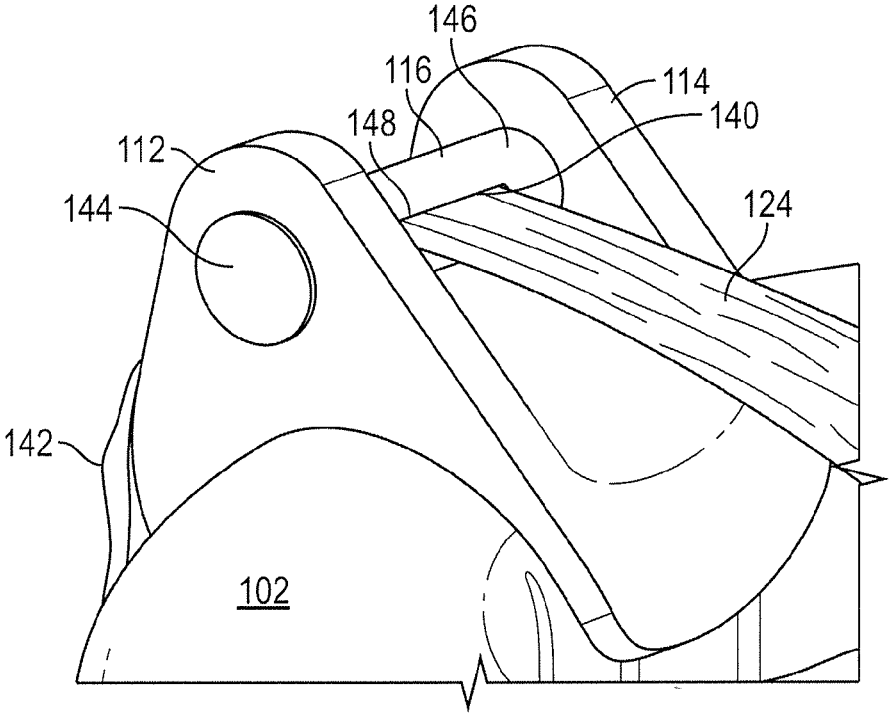
FIG. 8 is an enlarged, isometric view of a water sprayer component and housing of the waterfall system illustrated in FIG. 1.

Referring now to FIGS. 2 and 4, the water sprayer 116 is mounted between the first and second mounting arms 112, 114. A dispensing outlet 140 of the water sprayer 116 is arranged to extend laterally between the first and second mounting arms 112, 114 and along an extent of the water sprayer 116. The pump 120 may supply water to the water sprayer 116 through water passage(s) 152 (FIG. 6) disposed in one or both mounting arms 112, 114, through a sprayer hose 142 operatively coupled to a rear or bottom portion of the water sprayer 116, through the rear, second retention arm 110, and/or by some combination of these elements. Referring ahead to FIGS. 6 and 8, the sprayer hose 142 may traverse a water passage 152 disposed in the mounting arm 114. The water sprayer 116 may produce a wide, flat projection of water, as depicted in FIGS. 1 and 2. Alternatively, the water sprayer 116 may produce a thinner stream of water.

Figure 7:
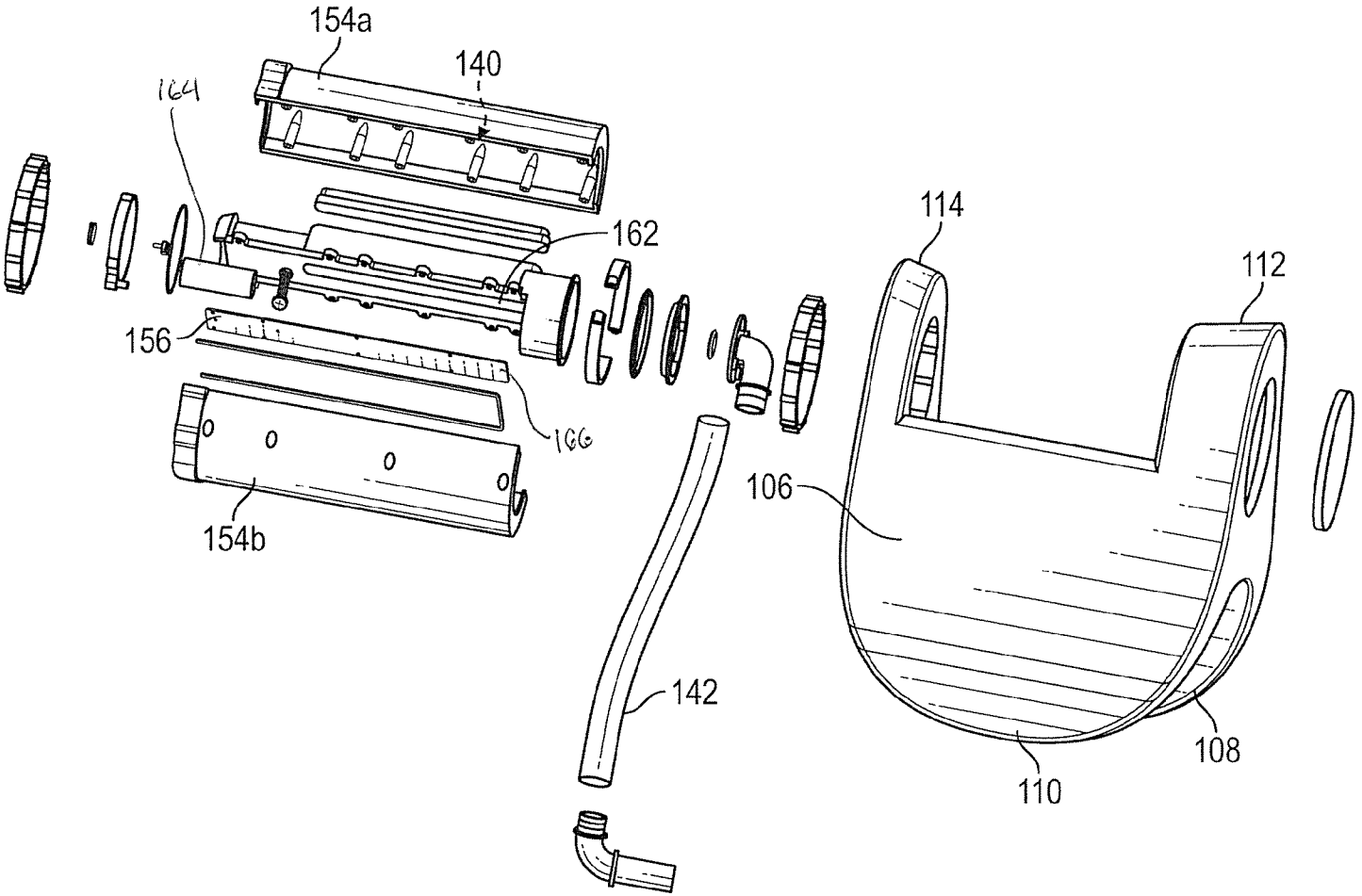
FIG. 7 is an enlarged, exploded, rear view of the water sprayer system of FIG. 1.
Figure 9:
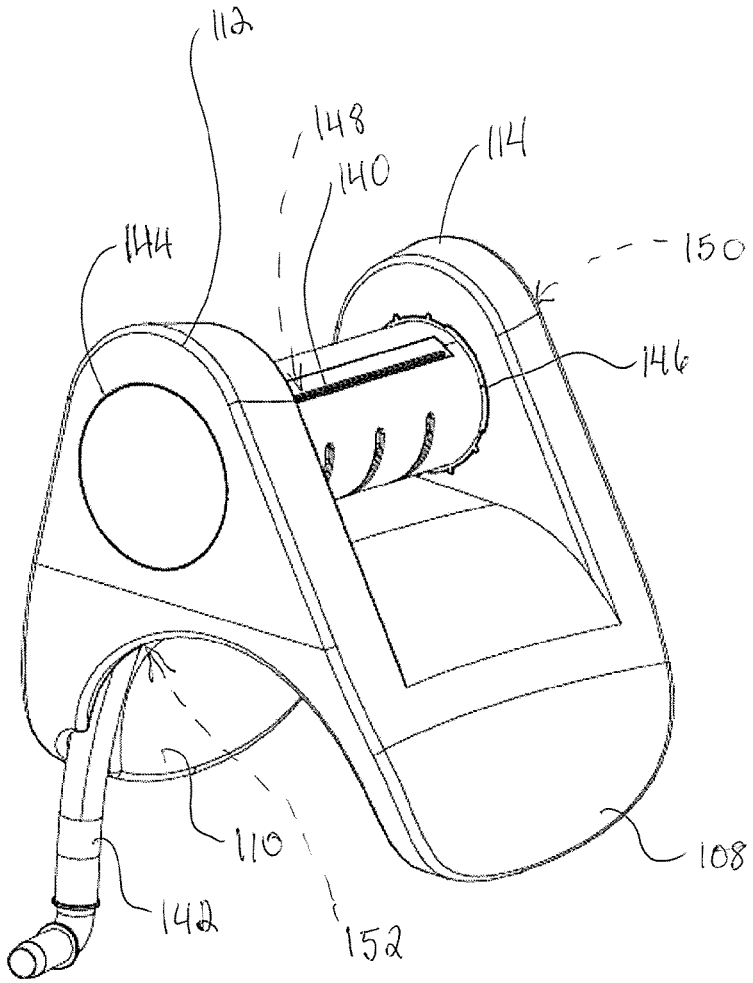
FIG. 9 is an enlarged, isometric view of the waterfall system of FIG. 1 with the inflatable pool/spa omitted.

Referring ahead to FIGS. 8 and 9, the water sprayer 116 may rotate about first and second mounting points 144, 146 disposed on the first and second mounting arms 112, 114. Still further according to example embodiments, the water sprayer 116 may incorporate one or more lighting elements 148, such as one or more LED elements (FIGS. 6 and 7). The waterfall system 100 may direct the light from said lighting element(s) towards the projected water 124 thereby developing a hue within the water and producing a desirable coloration effect. The one or more lighting elements 148 may change the color of light produced so as to produce a rainbow or color-shifting waterfall effect. In accordance with example embodiments, the waterfall system 100 may have a hydroelectric element for harnessing energy produced by the falling water. This hydroelectric element then provides power to the one or more lighting elements 148, and/or other features and amusements that are compatible with the inflatable pool/spa 104.

Referring once again to FIGS. 1 and 2, the shape of the housing body 106 may facilitate attachment of the waterfall system 100 to the side surface 102 of the inflatable pool/spa 104. One or more additional fasteners may be disposed along the housing body 106, such as on the first and second retention legs 108, 110. In the illustrated example embodiment of FIG. 1, the first and second retention legs 108, 110 and the first and second mounting arms 112, 114 are rotated about a central axis (or a generally/substantially central axis) of the housing body 106 about 90 degrees, such that the arms and legs are offset 90 degrees relative one another.

Figure 5:
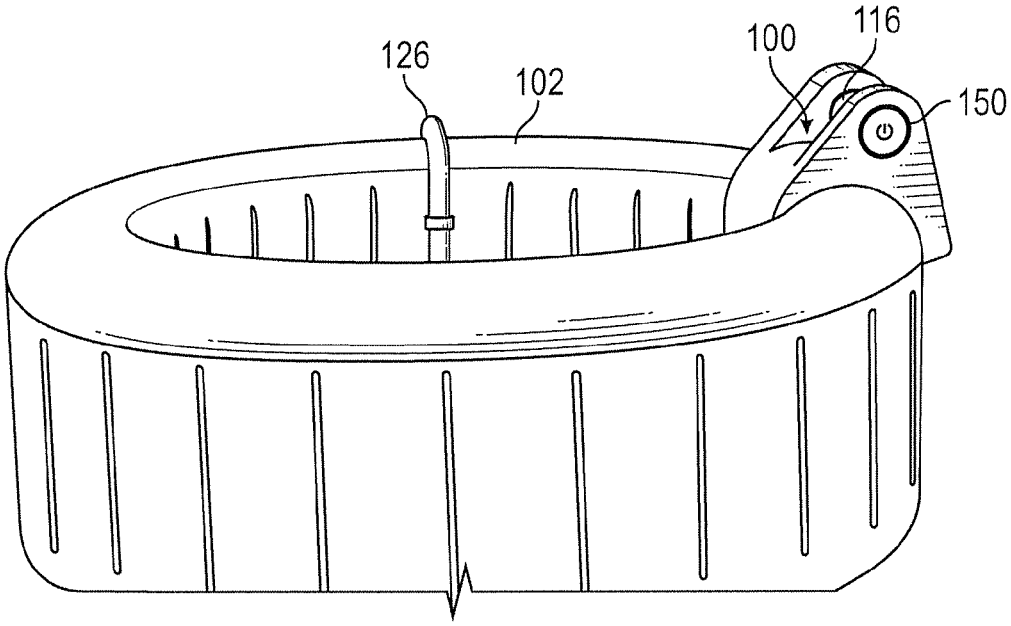
FIG. 5 is a front isometric view of the waterfall system of FIG. 1 depicting a second side thereof.

Referring now to FIG. 5, the system 100 for producing a waterfall effect is depicted from another side thereof. The flexible portion 128 of the hose 126 is shown extending over the side surface 102 of the inflatable pool/spa 104 and into the water contained therein. Further, a control button 150 is visible on the side of the water sprayer 116. The control button 150 may provide on/off control of the water sprayer 116, the one or more lighting elements 148, and/or other suitable accessories. The control button 150 may have relatively simple on/off capabilities for the one or more features noted. However, in embodiments, the control button 150 may respond to pressing sequences and/or durations so as to control additional or more complex accessories. For example, a single press of the control button 150 may turn on the water sprayer 116, a second press of the control button may turn on the one or more lighting elements 148, and a third press may turn off both the water sprayer 116 and the one or more lighting elements 148. Additional or alternative sequences are further contemplated hereby. Still further, sequences and/or durations of presses of the control button 150 may turn on/off particular strings of LEDs. Additionally, presses the control button 150 may change a quality of the light emitted by the one or more light elements 148. For example, each press of the control button 150 may change the color of the emitted light. Also in embodiments, presses of the control button 150 may change the brightness of the emitted light.

An exploded view of the water sprayer 116 is illustrated in FIGS. 6 and 7. In this example embodiment, the water sprayer 116 is exploded laterally out from the first and second mounting arms 112, 114 that hold the water sprayer 116 during operation (FIGS. 1, 2, and 4). The water passage 152 through which the sprayer hose 142 traverses is disposed through the mounting arm 114. FIG. 9 further depicts the arrangement of the sprayer house 142 within the housing 106. The control button 150 is depicted as exploded away from the mounting arm 114. Further, the water sprayer 116 includes a sprayer housing 154 (FIG. 6), which is further exploded into first and second sides 154*a*, 154*b* of the sprayer housing 154 in FIG. 7. The water dispensing outlet 140 extends along the sprayer housing 154. One or more sections of printed circuit board (PCB) 156 may be mounted within the sprayer housing 154 on a PCB mounting 158. The one or more lighting elements 148, such as one or more LEDs 160, may be disposed on the PCB(s) 156 along with control circuitry 166 for driving and operating the one or more LEDs 160. Further, the PCB(s) 156 and the one or more lighting elements 148 may be protected from water passing through the water sprayer 116 by a transparent, or partially transparent, window 162. The window 162 may be a component of the PCB mounting 158 disposed between the PCB(s) 156 and the water dispensing outlet 140. A gasket or other water-tight seal may be disposed about the one or more PCBs 156 to prevent water from contacting the electronic components. Included with the electronic components is a power source 164, such as a battery, for energizing the one or more LEDs 160 and the control circuitry 166. The one or more lighting elements 148 may emit light through the window 162 and, in turn, through the water and the water dispensing outlet 140. Accordingly, a coloration/illumination effect of the waterfall provided by the system 100 may be produced. As previously described hereinabove, the control button 150 may energize the one or more lighting elements 148 when pressed and/or may change the lighting color emitted by the one or more lighting elements 148.

The embodiment(s) detailed hereinabove may be combined in full or in part, with any alternative embodiment(s) described.

INDUSTRIAL APPLICABILITY

The above disclosure may represent an improvement in the art because it allows for addition of the disclosed waterfall producing system and apparatus to the side of an inflatable pool/spa. Further, this disclosure provides the user with improved water circulation and an entertaining arc of water. Still further, the disclosure improves the art by supplying an alternative water source for pumping water through a sprayer, such as that used by the device. That the hose for accessing pool/spa water is separate, and not necessarily integrated into the pool/spa, may represent even further portability, convenience, and user satisfaction.

It is to be understood that all described elements and features in this disclosure can be formed of any number of materials including, but not limited to, polymers, rubbers, foams, ceramics, metals, metal alloys or any other material known to those skilled in the art. In particular, the material forming the hose 126, and/or inflatable pool/spa 104 may be plastic, vinyl, coated fabric, and/or another suitable material or combination of materials. Valve(s) disposed on these components may be formed from extruded plastic, machined aluminum, another metal alloy, and/or another materials or combination of materials suitable for manufacturing valve(s) for inflatables.

While some implementations have been illustrated and described, numerous modifications come to mind without significantly departing from the spirit of the disclosure; and the scope of protection is only limited by the scope of the accompanying claims.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. A waterfall system, comprising:

a housing, the housing comprising:

two retention legs, each of which is curved and thereby configured to hold the housing to a side surface of an inflatable spa; and two mounting arms;

a water sprayer configured to be held above the inflatable spa by the two mounting arms, wherein the water sprayer is adapted to cause water to spray onto at least one of the two retention legs prior to entering the inflatable spa;

a water collection attachment comprising a hose configured to be disposed over the side surface of the inflatable spa, the hose comprising:

an arcuate saddle having a shape configured to correspond to the side surface of the inflatable spa, and a flexible portion disposed within the acruate saddle, wherein the arcuate saddle comprises of one of:

a clip configured to correspond to a clipping surface of the inflatable spa, an elastic material configured to clip over the side surface of the inflatable spa, and one or more finger projections disposed on an underside thereof, the one or more finger projections configured to slide into a corresponding one or more sleeves disposed on the side surface of the inflatable spa; and a pump configured to pump water from the inflatable spa, through the water collection attachment, and to the water sprayer.

2. The waterfall system of claim 1, wherein the water sprayer is horizontally held between the two mounting arms.

3. The waterfall system of claim 1, further comprising a power source supplying power to the pump.

4. The waterfall system of claim 1, wherein the two retention legs are offset from the two mounting arms.

5. The waterfall system of claim 1, wherein the two retention legs are offset from the two mounting arms by 90 degrees.

6. The waterfall system of claim 1, wherein an intake end of the water collection attachment is connected to the pump, such that the pump is configured to pull water from the inflatable spa and provide water to into the water collection attachment.

7. The waterfall system of claim 1, wherein an intake end of the water collection attachment is configured to be disposed within the inflatable spa, such that the pump is configured to pull water from the inflatable spa into the intake end of the water collection attachment.

8. The waterfall system of claim 1, wherein the water sprayer is rotatable with respect to the two mounting arms.

9. The waterfall system of claim 1, further comprising one or more lighting elements.

10. The waterfall system of claim 9, wherein light is emitted from the water sprayer proximal the water that is projected out of the water sprayer.

* * * * *